US008777283B2

(12) United States Patent
McNair

(10) Patent No.: US 8,777,283 B2
(45) Date of Patent: Jul. 15, 2014

(54) HANDS-FREE WASTE COLLECTION AND DISPOSAL DEVICE AND METHOD OF USE

(71) Applicant: C. Chantal McNair, Lubbock, TX (US)

(72) Inventor: C. Chantal McNair, Lubbock, TX (US)

( * ) Notice: Subject to any disclaimer, the term of this patent is extended or adjusted under 35 U.S.C. 154(b) by 0 days.

(21) Appl. No.: 13/902,257

(22) Filed: May 24, 2013

(65) Prior Publication Data

US 2013/0313842 A1 Nov. 28, 2013

Related U.S. Application Data

(60) Provisional application No. 61/651,250, filed on May 24, 2012.

(51) Int. Cl.
*A01K 29/00* (2006.01)
*E01H 1/12* (2006.01)

(52) U.S. Cl.
CPC ..... *E01H 1/1206* (2013.01); *E01H 1/12* (2013.01); *E01H 2001/1293* (2013.01)
USPC ..... 294/1.4; 294/1.5

(58) Field of Classification Search
CPC . E01H 1/12; E01H 1/1206; E01H 2001/1293; E01H 2001/128; A01B 1/022; A01B 1/18; A01K 23/005; A01K 1/0107; A01K 1/0114; A01K 1/011; A47L 13/52; A47L 13/08; A46B 15/0002; A46B 15/0055; A46B 2200/1066; B65F 1/1415; B65F 1/0006; B65F 1/06; B65D 33/007; B65D 85/52
USPC ..... 294/1.4, 1.5, 50, 50.5, 51, 52; 119/161, 119/867; 15/257.1–257.3, 236.08, 236.01, 15/105, 111; D30/162; 383/33
See application file for complete search history.

(56) References Cited

U.S. PATENT DOCUMENTS

| | | | | | |
|---|---|---|---|---|---|
| 4,097,082 | A * | 6/1978 | Orofino | 294/1.4 |
| 4,179,145 | A * | 12/1979 | Shinsako | 294/1.4 |
| 5,131,704 | A * | 7/1992 | Li | 294/1.4 |
| 5,269,575 | A | 12/1993 | Parvaresh | |
| 5,350,208 | A * | 9/1994 | Heinrichson | 294/1.4 |
| 5,586,521 | A | 12/1996 | Kelley | |
| 6,237,972 | B1 | 5/2001 | Jung | |
| 6,386,606 | B1 * | 5/2002 | Marshall | 294/1.5 |
| 7,032,940 | B1 | 4/2006 | Smith | |
| 7,287,790 | B1 * | 10/2007 | Kitiashvili | 294/1.4 |
| 7,374,135 | B2 | 5/2008 | Romero | |
| 7,407,207 | B2 | 8/2008 | Yilmaz | |
| 7,431,361 | B2 * | 10/2008 | Pilas | 294/1.5 |
| 7,708,236 | B2 | 5/2010 | Romero | |
| 8,002,319 | B1 | 8/2011 | Hahn | |
| 8,292,339 | B1 | 10/2012 | Auseklis | |
| 8,312,599 | B2 | 11/2012 | Vogl et al. | |
| 2002/0139101 | A1 * | 10/2002 | Crites | 56/400.12 |
| 2010/0171005 | A1 | 7/2010 | Romero | |
| 2010/0237203 | A1 | 9/2010 | Romero | |

* cited by examiner

*Primary Examiner* — Stephen Vu
(74) *Attorney, Agent, or Firm* — Sarah Hegi Simpson; McWhorter, Cobb & Johnson, LLP

(57) ABSTRACT

A hands-free waste collection and disposal device and a method of use are disclosed herein. The disclosed device generally comprises a waste receptacle and a collection tool. The waste receptacle includes an elongated handle, a waste receiving member attached to a second end of the elongated handle, and retractable members connected to the waste receiving member, wherein the retractable members are movable between a bag-supporting position and a bag-release position. The collection tool includes an elongated handle, a rake head connected to a second end of the elongated handle, and a scraper member attached to a rear face of the rake head.

22 Claims, 6 Drawing Sheets

HANDS-FREE WASTE COLLECTION AND DISPOSAL DEVICE AND METHOD OF USE

CROSS-REFERENCE TO RELATED APPLICATIONS

This application is related to and claims priority from earlier filed U.S. Provisional Patent Application No. 61/651,250, filed May 24, 2012, the disclosure of which is incorporated herein by reference.

BACKGROUND OF THE INVENTION

1. Field of the Invention

The present invention generally relates to the collection and disposal of waste. More specifically, the present invention relates to a hands-free waste collection and disposal device that may be used to collect and dispose of various types of waste including pet waste.

2. Description of Related Art

It is estimated that over 73 million American households own at least one pet. While pets provide their owners with unconditional love and companionship, unfortunately, pets also provide their owners with the unwanted burden of collecting and disposing of pet waste.

Not only is it unsightly and carries a foul odor, the waste pets leave behind poses numerous hazards to human health and animal health. Pet waste harbors a variety of harmful pathogens and parasites (e.g., adenovirus, parvovirus, giardia, campylobacter, salmonella, roundworm, hookworm tapeworm, etc.), and when pet waste is not properly collected and disposed of, such microorganisms are easily transmitted to humans and other pets. Further, uncollected pet waste left in public areas, such as streets, sidewalks and parks, is a common public health nuisance to which many municipalities have responded by enacting local ordinances requiring pet owners to clean up after their pets.

Another problem with uncollected pet waste is that, unlike grain-based cow and horse manure, dog and cat waste is protein-based, making it unusable as fertilizer for lawns and plants. As many pet owners unhappily discover, uncollected pet waste inhibits growth and eventually kills lawns and plants.

Uncollected pet waste also plays a significant role in water pollution. The Environmental Protection Agency has deemed pet waste a "nonpoint source of pollution," putting pet waste in the same category as oil and toxic chemicals. Nonpoint source pollution is caused by rainfall or snowmelt moving over and through the ground. As the runoff moves, it picks up and carries away pollutants, such as pet waste, finally depositing them into lakes, rivers, wetlands, coastal waters, and even into our underground sources of drinking water.

Collecting pet waste and disposing of it properly, therefore, is not merely an activity performed to improve the visual appearance and smell of household lawns and public areas; it is an important public and environmental health and safety activity. Yet, using current methods and devices, the collection and disposal of pet waste is an unpleasant and unsanitary task that discourages owners from cleaning up after their pets.

Currently, many pet owners resort to using a plastic bag to cover one hand and pick up pet excrement by hand. Many owners, however, are understandably repulsed by such a collection technique. In an effort to minimize the unpleasantness of the collection and disposal of pet waste, devices, commonly referred to as "pooper-scoopers," have been developed for collecting pet waste. Design problems in such devices, however, present several disadvantages that are overcome by the present invention.

Current pooper-scooper devices generally consist of a long-handled device attached to a rigid tray or shovel used to scoop up and collect pet waste. The elongated handle on such devices is intended to eliminate the need for the user to bend down to collect the waste and to increase the distance between the user and the waste during collection. However, when using such devices, users oftentimes must bend down and use a nearby object, such as a stick or the like, to push the waste onto the tray. Such a collection method often soils the user's hands and forces the user to come into closer proximity with the waste than is desired.

Other known pooper-scooper devices consist of a long-handled device attached to a ring-shaped frame that is configured for attachment of a disposable bag by using an elastic band or the like to attach the bag to the frame. Once the bag is full of collected waste, the disposable bag must be removed from the device by hand. Users oftentimes soil their hands when they attempt to remove such a bag from the scooper device, providing for a rather messy and unsanitary method of use.

In an effort to solve problems associated with the above-described pooper-scooper devices, other known devices have been developed that consist of an elongated handle attached to a jaw-type scoop, which defines two opposing jaw sections that are pivotally connected at a top portion to allow the jaw sections to open and close to collect pet waste. While such devices overcome the problem of needing a stick or other external object to force the waste into the scoop, these jaw-type scooper devices are overly complex and include many parts that are prone to breakage. Additional problems experienced with such devices include the difficulty of positioning the two jaw sections beneath the waste for collection of entire piles of excrement without unintentionally leaving some behind; the inefficiencies resulting from the requirement to dispose of each pile of waste before re-opening the jaw sections to collect a separate pile of waste; the inability to collect waste that is not completely solidified; the destruction such devices cause to lawns as the clamping jaw sections oftentimes grab and tear up the grass and soil surrounding collected piles of waste; and the difficulty and unpleasantness of cleaning pet waste, grass and soil from the jaw sections.

It is therefore clear that a need exists for a device that provides clean, efficient and essentially hands-free collection and disposal of pet waste in a convenient and sanitary fashion. A waste collection and disposal device is needed that is simple in construction, that is not prone to breakage, and that provides for a collection and disposal method that does not soil the user's hands. A device and collection method are needed that do not require the user to bend down to collect the waste. Additionally, a device and method are needed that increase the distance between the user and the waste during collection and disposal of the waste. Such a device and method are needed to minimize the unpleasantness of the collection and disposal of pet waste in order to encourage more pet owners to clean up after their pets. Furthermore, a device is needed that provides a collection method that does not uproot or harm areas of grass lying beneath collected piles of waste. In addition, there is a need for a device that provides a means for collecting both solid and unsolidified piles of pet excrement. Finally, such a device is needed that further provides for hands-free collection and disposal of various types of waste including garbage, debris and the like.

In view of the foregoing, it is apparent that a need exists in the art for a hands-free waste collection and disposal device which overcomes, mitigates or solves the above problems in the art. It is a purpose of this invention to fulfill this and other needs in the art which will become more apparent to the skilled artisan once given the following disclosure.

OBJECTS AND SUMMARY OF THE INVENTION

It is an object of the present invention to overcome the above-described drawbacks associated with current devices. To achieve these and other advantages and in accordance with the purpose of the invention, as embodied and broadly described, the present disclosure describes a hands-free waste collection and disposal device and method of use. By utilizing a unique waste receptacle, collection tool, and hands-free bag release mechanism, the disclosed device overcomes many problems experienced with current devices.

The disclosed device includes a waste receptacle that generally comprises an elongated handle; a waste receiving member attached to a second end of the elongated handle; and retractable members connected to the waste receiving member. The waste receiving member includes a bottom wall connected to a top wall by a first side wall and by a second side wall. The waste receiving member further includes a waste receiving opening and a waste outlet opening that connect to form an interior pathway through the waste receiving member.

In operation, a conventional disposable bag (e.g., a plastic grocery bag) is placed around the waste outlet opening of the waste receiving member. The bag is releasably secured to the waste receiving member by wrapping the two handles of the bag around the retractable members protruding from the waste receiving member. To release the bag, the retractable members are forced to retract into the interior of the waste receiving member to a bag-release position. This forces the handles to detach from the retractable members and allows the bag to completely detach from the waste receiving member and fall into a proper disposal container, such as a garbage bin or the like.

The disclosed device further includes a collection tool that generally comprises an elongated handle; a rake head, including a plurality of tines, attached to a second end of the handle; and a scraper member attached to a rear face of the rake head.

The configuration of the disclosed hands-free waste collection and disposal device provides many advantages over current devices. The elongated handles of the waste receptacle and the collection tool allow users to remain in a standing position while collecting waste so that users do not have to bend down to push waste into the waste receptacle. Users simply use the disclosed collection tool to gather and push waste into the waste receiving opening and then tilt the waste receiving member in a manner that allows the waste to slide into the attached bag. The collection tool can also be used to push waste through the interior pathway of the waste receiving member and into the attached bag.

A further advantage provided by the disclosed device is that users are able to remain in a standing position while disposing of collected waste. The disclosed hands-free disposal method allows a user to quickly and effortlessly dispose of an attached bag full of waste by operating the hands-free bag release mechanism so that the user does not have to bend down to detach the bag from the waste receiving member by hand. To operate the hands-free bag release mechanism, a sliding member, attached to the handle of the waste receptacle and to a spring-loaded push rod member disposed within the handle, can be moved in a downward direction towards the waste receiving member to force the retractable members to retract into the waste receiving member. This forces the bag handles to detach from the retractable members and allows the bag to completely detach from the waste receiving member and fall into a proper disposal container without the user ever touching the bag.

By eliminating the need for the user to bend down near the waste during the collection and the disposal processes, the disclosed device increases the distance between the user and the waste during collection and disposal of the waste. This helps to minimize the unpleasantness of waste collection and disposal.

Unlike many existing waste collection and disposal devices that consist of one tool designed to simultaneously serve as both a collection device and as a receptacle for temporarily holding the collected waste, the disclosed device includes two separable parts that may be stored and carried as one device but that may be separated and used as two separate tools to provide for efficient and effective removal of waste from various surfaces. Devices consisting of only one tool have many drawbacks compared to the disclosed device, including the inability to effectively remove waste from many surfaces, the inefficient collection method provided by such devices as the user must dispose of pet waste into a disposal container after each pile of waste has been collected, and the increased likelihood of a user soiling their hands during waste collection and disposal.

In comparison, the two separable parts of the disclosed device effectively remove waste from many outdoor and indoor surfaces including grass, concrete, hard flooring, etc. This advantage is provided by the collection tool of the disclosed device, which is provided with a rake head having a plurality of tines, as well as a scraper member attached thereto. The rake tines and the scraper member included on the collection tool allow a user to easily and effectively pick up entire piles of waste without inadvertently leaving portions of the waste behind and without harming or uprooting areas of grass lying beneath the collected waste. The rake tines are ideal for collecting waste from grass and similar surfaces, while the scraper member is ideal for collecting waste from solid surfaces such as concrete or hard flooring. Additionally, while solid wastes can typically be collected with the rake tines, unsolidified waste or waste that has dried and hardened onto a surface can be collected with the scraper member.

Another advantage provided by the disclosed device is that the disclosed device provides for a sanitary collection and disposal method and prevents users from soiling their hands. Since the disclosed device includes two separable devices with elongated handles, the user's hands never get near the collected waste. Likewise, the hands-free bag release mechanism allows the collected waste and bag to be finally disposed of without ever being touched by the user.

The disclosed device further provides a quick and efficient method of collecting and disposing of waste. A relatively large amount of waste or numerous piles of waste can be collected in the attached bag before finally disposing of the bag and the collected waste. When waste has been deposited in the attached bag, gravity pulls the collected waste to the closed end of the bag in a downward direction away from the waste outlet opening of the waste receiving member. As a result, waste that has been collected in the attached bag stays in the bag and does not spill out through the interior pathway of the waste receiving member when a separate pile of waste is being collected.

Furthermore, unlike many existing waste collection and disposal devices, the disclosed device does not include a multitude of parts that are prone to breakage. The disclosed device is simple in construction and economical in cost to manufacture. Plus, users will appreciate the advantage of using recycled plastic grocery bags with the device, rather than being forced to purchase specialized plastic bags for use with the device as is required with many current devices.

These, together with other objects of the invention, along with various features of novelty that characterize the invention, are pointed out with particularity in the claims annexed hereto and forming a part of this disclosure. For a better understanding of the invention, its operating advantages, and the specific objects attained by its uses, reference should be had to the accompanying drawings and descriptive matter in which there is described illustrative embodiments of the invention.

BRIEF DESCRIPTION OF THE DRAWINGS

The accompanying drawings, which are incorporated in and form a part of the specification, illustrate embodiments of the present invention, and together with the description, serve to explain the principles of the invention. It is to be expressly understood that the drawings are for the purpose of illustration and description only and are not intended as a definition of the limits of the invention. In the drawings.

DETAILED DESCRIPTION OF ILLUSTRATIVE EMBODIMENTS

In the following discussion, the terms upper, lower, top, bottom, front, rear, above, beneath, upward, downward, and the like are used to describe the embodiments of the invention as illustrated in the accompanying figures. Such terms are relative and are used herein to describe the figures for illustration purposes only and are not intended to limit the embodiments shown to any particular orientation.

Referring now to FIGS. 1-7, exemplary embodiments of a hands-free waste collection and disposal device 10 and methods of use in accordance with the present disclosure are illustrated. As shown in the accompanying figures, the hands-free waste collection and disposal device 10 includes a waste receptacle 11. The waste receptacle 11 generally comprises an elongated handle 13 having a first end and a second end; a waste receiving member 17 attached to the second end of the handle 13; and retractable members 18*a* and 18*b* connected to the waste receiving member 17.

Figure 1:
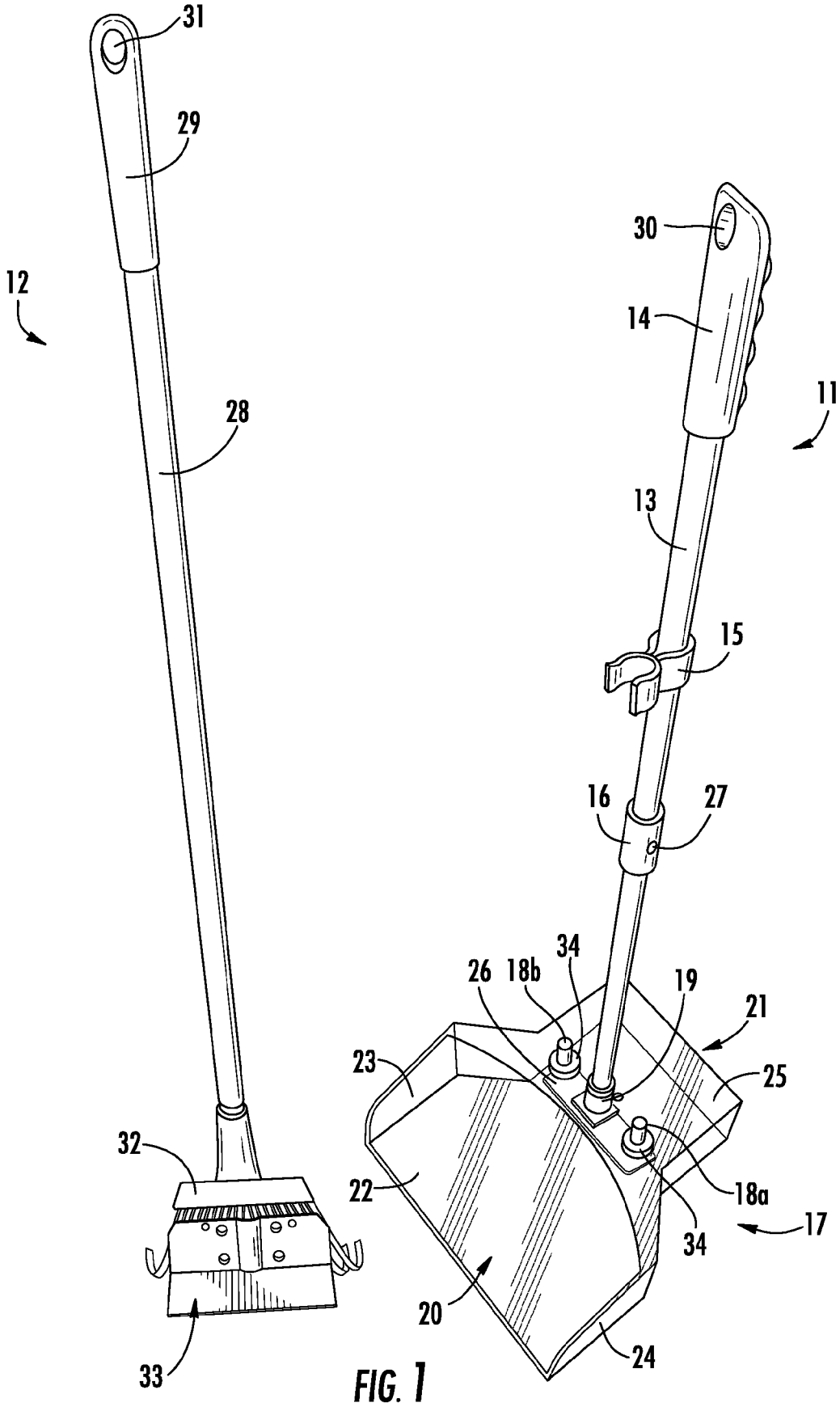
FIG. 1 is a perspective view of a device constructed in accordance with the teachings of the present disclosure.
Figure 2:
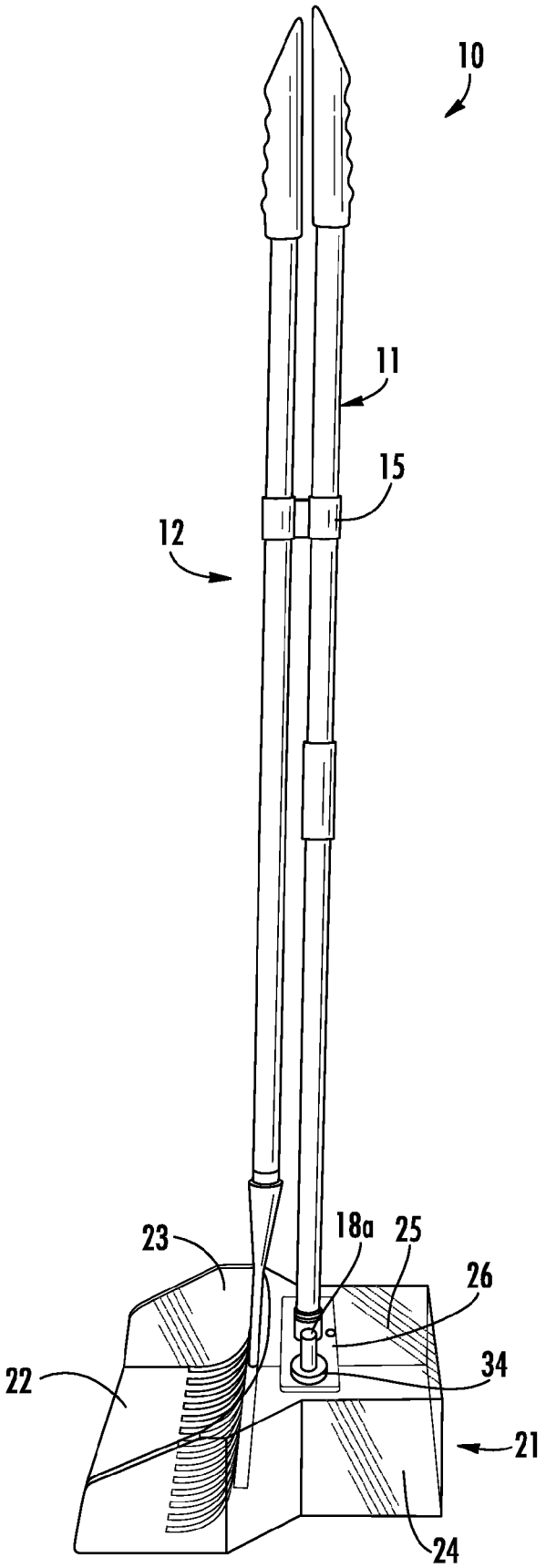
FIG. 2 is a side perspective view of the device depicted in FIG. 1.

In the embodiment shown in FIGS. 1 and 2, the first end of the handle 13 includes a handgrip 14 attached thereto to provide a comfortable and secure grip for the user. The first end of the handle 13 may further include a hole 30 for hanging the waste receptacle 11 on a wall for convenient storage of the waste receptacle 11.

The second end of the disclosed waste receptacle handle 13 is attached to the waste receiving member 17. In the attached figures, a handle attachment member 19, arranged and configured to receive the second end of the handle 13, is attached to a top wall 25 of the waste receiving member 17. In one embodiment of the present invention, the second end of the handle 13 is simply inserted into the handle attachment member 19 and attached thereto with fasteners. One skilled in the art can appreciate that numerous possibilities exist for attaching the handle 13 to the waste receiving member 17, all of which are considered to be within the spirit and scope of the present invention.

The handle 13 of the waste receptacle 11 may further include a collection tool holder 15 disposed between the first end and the second end of the handle 13. The collection tool holder 15 allows the device 10, which includes two separable parts, to be carried and stored as one device, as depicted in FIG. 2. In the embodiment depicted in FIG. 1, the collection tool holder 15 defines a semi-flexible member, attached to the waste receptacle handle 13, that allows for removable insertion of a portion of the collection tool handle 28 via a snap-in movement. FIG. 2 illustrates a side view of the disclosed device 10, wherein the collection tool 12 is attached to the waste receptacle 11 by inserting a portion of the collection tool handle 28 into the collection tool holder 15. Other means for releasably attaching the collection tool 12 to the waste receptacle 11 that are known in the art may also be used and are considered to be within the spirit and scope of the present invention.

Figure 4:
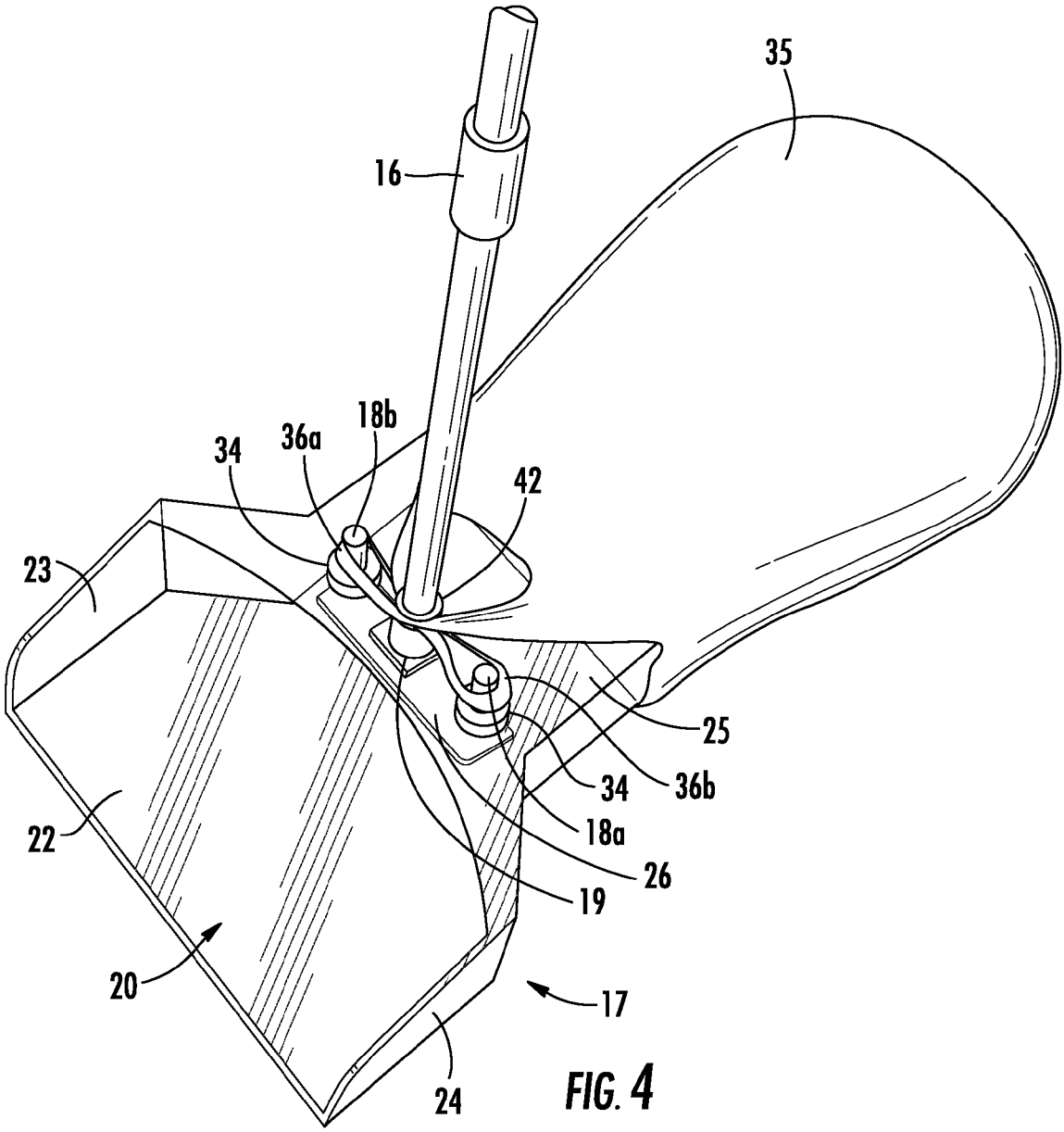
FIG. 4 is a partial view of the device shown in FIG. 1, showing the waste receiving member of the waste receptacle.

As depicted in FIG. 1, the waste receiving member 17 of the disclosed waste receptacle 11 includes a bottom wall 22 connected to a top wall 25 by a first side wall 23 and by a second side wall 24. The waste receiving member 17 further includes a waste receiving opening 20 and a waste outlet opening 21 that connect to form an interior pathway through the walls of the waste receiving member 17. In use, collected waste is first received by the waste receiving member 17 through the waste receiving opening 20. The waste is then urged from the waste receiving opening 20 through the waste outlet opening 21 into a bag 35 attached around the waste outlet opening 21, as shown in FIG. 4. In the embodiments shown in the attached figures, the waste receiving member 17 includes a wide waste receiving opening 20 which turns into a narrower waste outlet opening 21. This configuration provides a wide area for receiving waste and a narrower area for easily passing the waste into an attached bag 35. Those skilled in the art will recognize that many configurations of waste receiving members may be utilized with the disclosed device 10, as the various embodiments of the present invention are not limited to the use of any particular configuration or shape of the waste receiving member.

Figure 7:
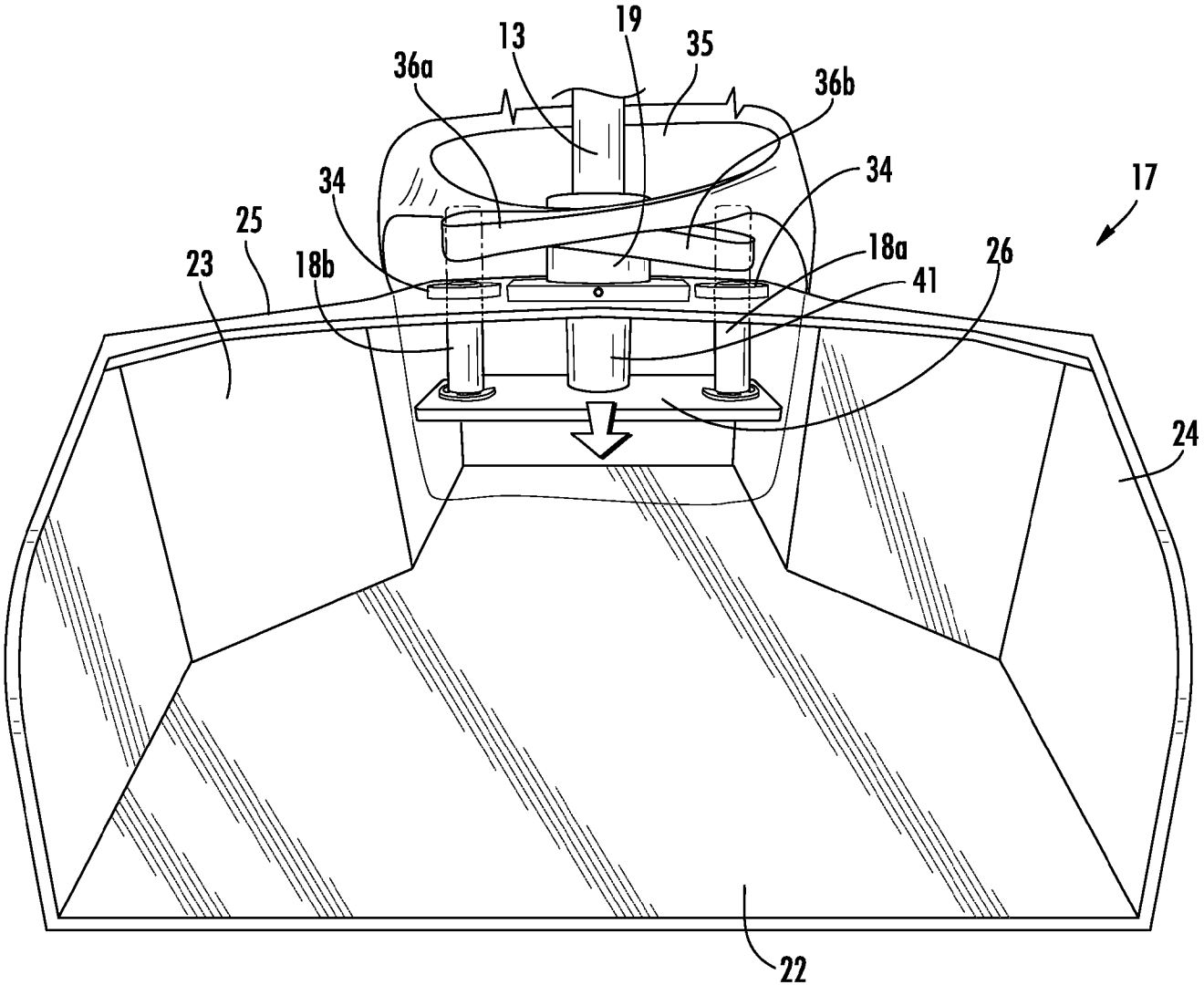
FIG. 7 is a magnified partial view of the waste receptacle shown in FIG. 5.

The disclosed waste receptacle 11 further includes retractable members 18*a* and 18*b* connected to the waste receiving member 17. The retractable members 18*a* and 18*b* are selectively adjustable from a bag-supporting position to a bag-release position. In the embodiments shown in the attached figures, the top wall 25 of the waste receiving member 17 includes apertures 34 for receiving the retractable members 18*a* and 18*b* and allowing the retractable members 18*a* and 18*b* to move between the bag-supporting position and the bag-release position. FIGS. 1, 2, 4, and 5 illustrate the retractable members 18*a* and 18*b* in the bag-supporting position, wherein the retractable members 18*a* and 18*b* protrude through the apertures 34 and above the top wall 25 of the waste receiving member 17. When in the bag-supporting position, the retractable members 18*a* and 18*b* are configured and arranged for attachment of bag handles 36*a* and 36*b* to the retractable members 18*a* and 18*b*, as depicted in FIG. 4. FIG. 7 illustrates the retractable members 18*a* and 18*b* in the bag-release position, wherein the retractable members 18*a* and 18*b* are retracted beneath the top wall 25 and into the interior of the waste receiving member 17. While the retractable members 18*a* and 18*b* illustrated in the attached figures are shown as substantially rod-shaped members, one skilled in the art can appreciate that there are numerous configurations and shapes that exist for designing the retractable members, all of which are considered to be within the spirit and scope of the present invention.

As illustrated in FIG. 1, the disclosed hands-free waste collection and disposal device 10 further includes a collection tool 12 that generally comprises an elongated handle 28 having a first end and a second end; a rake head 32 attached to the second end of said handle 28, said rake head 32 including a plurality of tines; and a scraper member 33 attached to a rear face of said rake head 32.

Figure 3:
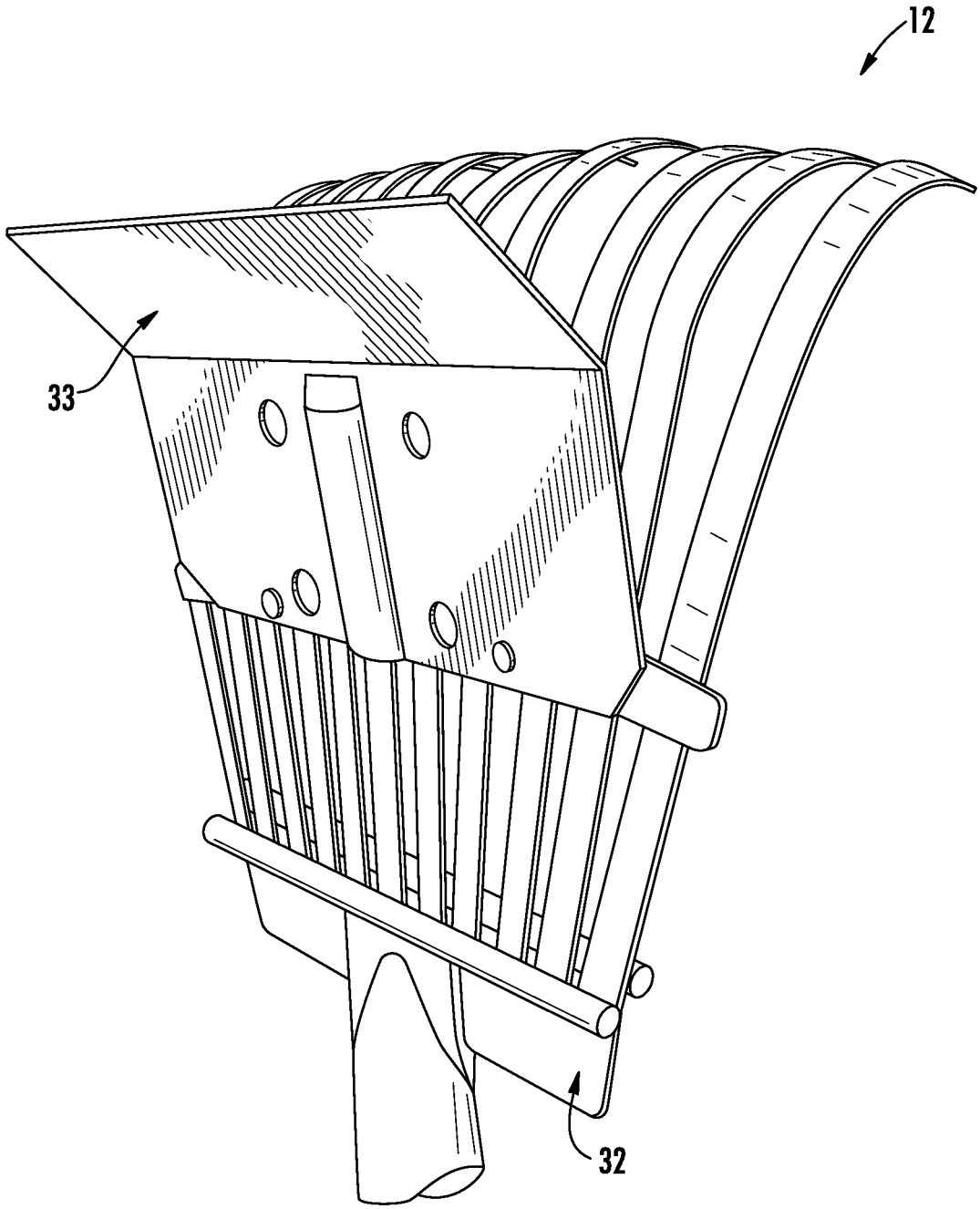
FIG. 3 is a partial view of the device shown in FIG. 1, showing the rake head of the collection tool.

Just like the handle 13 of the waste receptacle 11, the first end of the collection tool handle 28 may include a handgrip 29 attached thereto to provide a comfortable and secure grip for the user, as well as a hole 31 for hanging the collection tool 12 on a wall for convenient storage of the collection tool 12. The second end of the disclosed collection tool handle 28 is attached to the rake head 32. FIG. 3 depicts a magnified view of the rake head 32 which includes a plurality of tines for collecting waste, such as solidified pet waste, leaves, garbage, etc., into the waste receiving member 17 of the waste receptacle 11. The rake head 32 further includes a scraper member 33, attached to the rear face of the rake head 32, for collecting waste such as unsolidified waste, waste that has dried and hardened onto a surface, etc. The scraper member 33 may be attached to the rake head 32 using fasteners or any other suitable attachment means known to those skilled in the art.

Turning to FIG. 4, a bag 35, such as a conventional plastic grocery bag, is shown placed around the waste outlet opening 21 of the waste receiving member 17. The bag 35 includes an open end for placement around the waste outlet opening 21; a closed end for collection of waste; and a first handle 36*a* and a second handle 36*b* for securing the bag 35 to the retractable members 18*a* and 18*b* when the retractable members 18*a* and 18*b* are in a bag-supporting position.

In FIG. 4, the bag 35 is releasably attached to the waste receiving member 17 by placing the opening of the bag 35 around the waste outlet opening 21 of the waste receiving member 17. With the retractable members 18*a* and 18*b* in the bag-supporting position, the first bag handle 36*a* is passed between the handle attachment member 19 and a first retractable member 18*a* adjacent to the first bag handle 36*a*. The first bag handle 36*a* is then passed in front of the handle attachment member 19, and the opening in the first bag handle 36*a* is placed around a second retractable member 18*b*. Likewise, the second bag handle 36*b* is passed between the handle attachment member 19 and the second retractable member 18*b* adjacent to the second bag handle 36*b*. The second bag handle 36*b* is then passed in front of the handle attachment member 19, and the opening in the second bag handle 36*b* is placed around the first retractable member 18*a*. As shown in this embodiment, the handle attachment member 19 may further include a lip 42 projecting around the top portion of the handle attachment member 19. This lip 42 helps to hold the handles 36*a* and 36*b* in place around the front of the handle attachment member 19. In the depicted embodiment, the second end of the waste receptacle handle 13 is inserted into the handle attachment member 19. In alternative embodiments that do not include the handle attachment member 19 attached to the waste receiving member 17, the bag handles 36*a* and 36*b* are simply passed around the second end of the waste receptacle handle 13.

To detach the bag 35, shown in FIG. 4, from the waste receiving member 17, the retractable members 18*a* and 18*b* are forced to retract beneath the top wall 25 of the waste receiving member 17 to the bag-release position. As illustrated in FIG. 7, when the retractable members 18*a* and 18*b* retract into the interior of the waste receiving member 17, the bag handles 36*a* and 36*b* are forced to detach from the retractable members 18*a* and 18*b*. Once the handles 36*a* and 36*b* are no longer looped around the retractable members 18*a* and 18*b*, the weight of the bag 35 and any collected waste inside the bag 35, forces the bag 35 to slide off the waste outlet opening 21. In this manner, the bag 35 can be quickly and easily detached from the waste receiving member 17.

Figure 6:
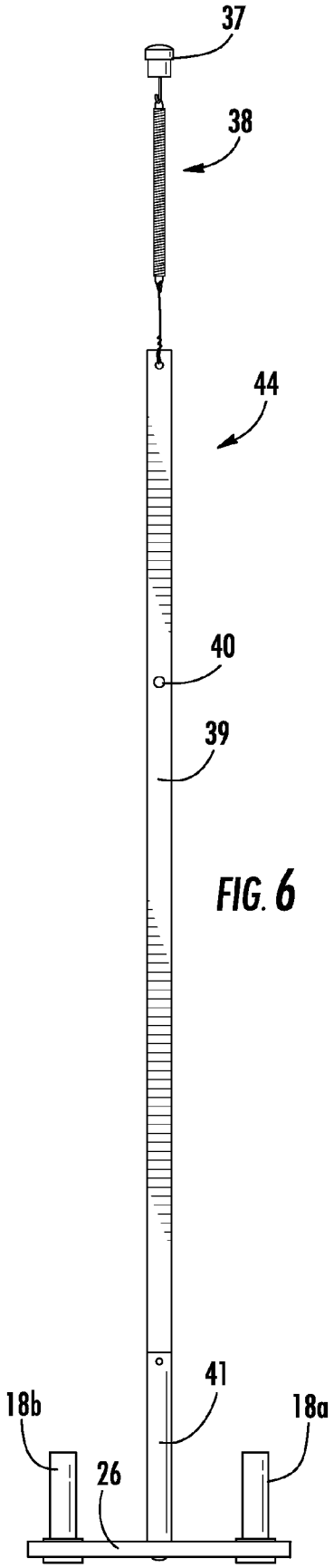
FIG. 6 is a plan view of the spring-loaded push rod member inside the waste receptacle shown in FIG. 5.
Figure 5:
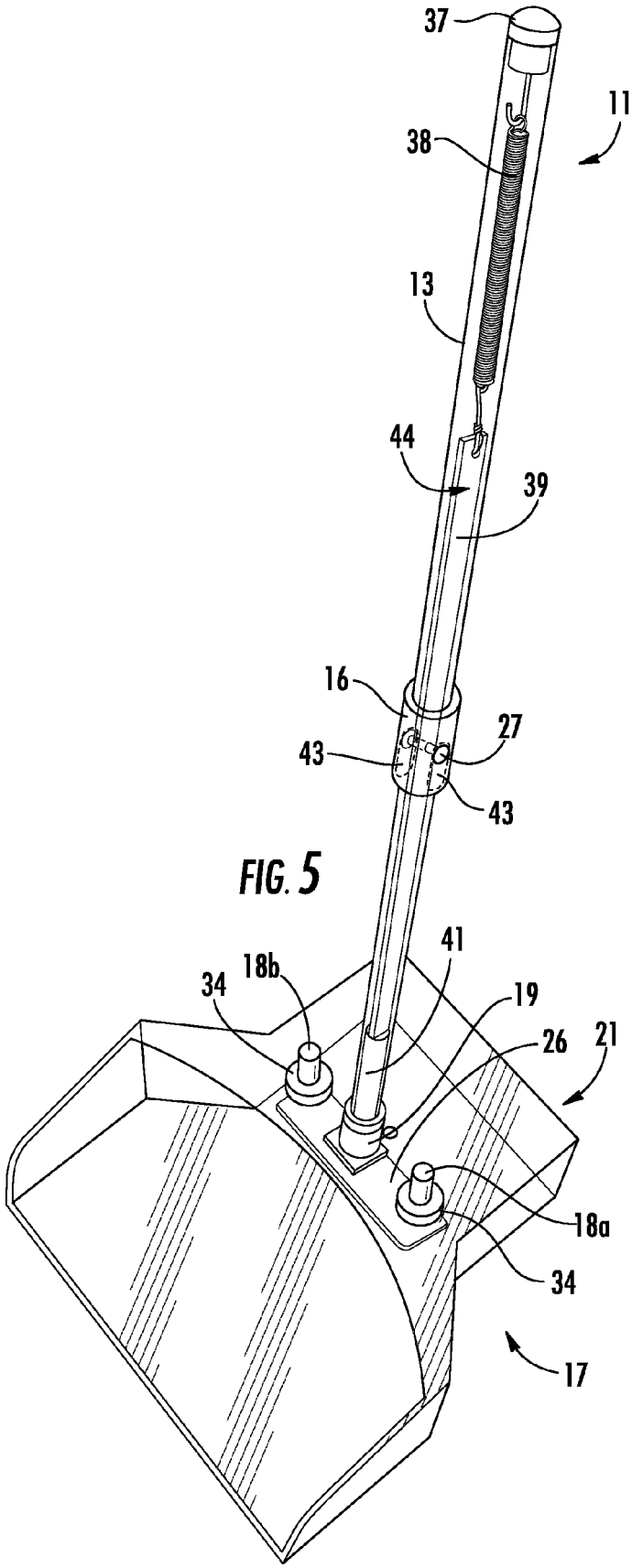
FIG. 5 is a perspective view of a waste receptacle constructed in accordance with the teachings of the present disclosure.

Turning to FIGS. 5 and 6, the waste receptacle 11 may further include a spring-loaded push rod member 44 for providing a hands-free bag release mechanism. The spring-loaded push rod member 44 is arranged and configured to force the retractable members 18*a* and 18*b* to retract to the bag-release position by simply moving a sliding member 16, connected to the push rod member 39, in a downward direction (in the orientation shown in FIG. 5) towards the waste receiving member 17. In the depicted embodiments, the spring-loaded push rod member 44 includes a top member 37; a resilient member 38 connected to the top member 37; and a push rod member 39 connected to the resilient member 38.

In one embodiment contemplated by the present invention and shown in FIG. 5, the handle 13 of the waste receptacle 11 is hollow in order to house the spring-loaded push rod member 44. The top member 37 of the spring-loaded push rod member 44 is disposed within the first end of the handle 13 and is attached to a first end of the resilient member 38. The second end of the resilient member 38 is attached to the push rod member 39. The resilient member 38 exerts an upward force on the push rod member 39 and yieldably opposes movement of the push rod member 39 in a downward direction. As depicted in FIG. 5, the resilient member 38 may define an extension spring or the like. Other resilient members also may be used and are considered to be within the spirit and scope of the present invention.

In FIG. 5, the push rod member 39 extends through the waste receptacle handle 13. The handle attachment member 19 in this embodiment includes a hollow, cylindrical body to allow the lower portion 41 of the push rod member 39 to move up and down through the handle attachment member 19. In addition, the top wall 25 of the waste receiving member 17 includes an aperture therethrough for receiving the lower portion 41 of the push rod member 39 and allowing the lower portion 41 of the push rod member 39 to move up and down through the top wall 25. In this embodiment, the lower portion 41 of the push rod member 39 is attached to a base 26. In FIG. 5, the base 26 is disposed adjacent to the bottom surface of the top wall 25 of the waste receiving member 17. The retractable members 18*a* and 18*b* are also attached to the base 26 and are received through apertures 34 in the top wall that are configured for receiving the retractable members 18*a* and 18*b*. The push rod member 39, in combination with the base 26, is configured in a manner that forces the retractable members 18*a* and 18*b* to move up and down through the apertures 34 in the top wall 25, as the push rod member 39 moves up and down. When a user is not manipulating the push rod member 39 by forcing the push rod member 39 in a downward direction, the arrangement and configuration of the resilient member 38 pulls the push rod member 39, along with the attached base 26 and retractable members 18*a* and 18*b*, in an upward direction so that the base 26 is held adjacent to the bottom surface of the top wall 25 of the waste receiving member 17 and the retractable members 18*a* and 18*b* protrude through the apertures 34 and above the top wall 25 in the bag-supporting position, as shown in FIG. 5. In this manner, the resilient member 38 retains the retractable members 18*a* and 18*b* in the bag-supporting position when the push rod member 39 is not being manipulated by a user.

In order to force the retractable members 18*a* and 18*b* to retract to the bag-release position, a user must force the push rod member 39 in a downward direction towards the waste receiving member 17 to overcome the upward force exerted on the push rod member 39 by the resilient member 38. As illustrated in the attached figures, the handle 13 of the waste receptacle 11 may further include a sliding member 16 that is connected to the push rod member 39 and that may be utilized for forcing the push rod member 39 in a downward direction. In the depicted embodiments, the sliding member 16 is disposed around a central portion of the waste receptacle handle 13 between the first end and the second end of the handle 13. The sliding member 16 is connected to the push rod member 39 in order to move the push rod member 39 in a downward direction when the sliding member 16 is moved in a downward direction towards the waste receiving member 17.

In the embodiment shown in FIG. 5, the portion of the handle 13 of the waste receptacle 11 located beneath the sliding member 16 further includes two slots 43. A fastener 27 is inserted through the sliding member 16, through the slots 43, and through an aperture 40 formed in the push rod member 39, so that the fastener 27 extends transversely through the handle 13. In this manner, the fastener 27 connects the sliding member 16 to the push rod member 39. The slots 43, formed longitudinally through the handle 13, allow the fastener 27 to move in a downward direction through the slots 43. Furthermore, since the fastener 27 is attached to the sliding member 16 and the push rod member 39, the slots 43 in the handle 13 allow the sliding member 16 and the push rod member 39 to move in a downward direction until the fastener 27 reaches the end of the slots 43. When the sliding member 16 is moved in a downward direction, the push rod member 39 connected to the sliding member 16 is moved in the downward direction. When the push rod member 39 is moved in the downward direction, the base 26 attached to the push rod member 39 is likewise moved in the downward direction. In addition, when the base 26 is moved in the downward direction, the retractable members 18*a* and 18*b* attached to the base 26 are moved in the downward direction. Thus, when the sliding member 16 is moved in the downward direction towards the waste receiving member 17, the retractable members 18*a* and 18*b* are forced to retract into the interior of the waste receiving member 17 to the bag-release position.

In the bag-release position, the resilient member 38 is extended or stretched to allow the push rod member 39 to be moved downwardly. As soon as the user releases the pressure applied to the sliding member 16 to move the sliding member 16 in the downward direction, the resilient member 38 reverts back to its natural compressed form, thereby pulling the push rod member 39, the base 26, and the retractable members 18*a* and 18*b* in an upward direction so that the base 26 is adjacent to the bottom surface of the top wall 25 and the retractable members 18*a* and 18*b* protrude through the apertures 34 and above the top wall 25 in the bag-supporting position.

To use the disclosed device 10 for waste collection and disposal, a bag 35 is attached to the retractable members 18*a* and 18*b* in the bag-supporting position, as described above. Using the collection tool 12, waste is collected and pushed into the waste receiving member 17 through the waste receiving opening 20 and then urged into the bag 35 through the waste outlet opening 21. When the user is ready to finally dispose of the bag 35 and collected waste into a proper disposal container, the user positions the waste receiving member 17 of the waste receptacle 11 over the disposal container so that the waste receiving opening 20 faces upward and the waste outlet opening 21 faces downward toward the disposal container. When held in this position, gravity pulls the bag 35 full of collected waste downward towards the disposal container. Then, the user simply moves the sliding member 16 in a direction towards the waste receiving member 17. This forces the push rod member 39 to move the base 26 and retractable members 18*a* and 18*b* into the interior of the waste receiving member 17, as shown in FIG. 7. When the retractable members 18*a* and 18*b* retract into the interior of the waste receiving member 17, the bag handles 36*a* and 36*b* are forced to detach from the retractable members 18*a* and 18*b*, allowing the bag 35 and collected waste to easily slide off the waste outlet opening 21 and fall into the disposal container.

Using this method, the user never has to touch the bag 35 after waste has been deposited into the bag 35. Alternatively, the user may release the bag 35 onto a ground surface and manually tie the bag handles 36*a* and 36*b* together. Since the bag handles 36*a* and 36*b* are secured on top of the waste receiving member 17 during the collection process and never come in contact with the collected waste, the bag handles 36*a* and 36*b* remain clean and the user's hands will not become soiled by tying the bag handles.

Although the accompanying figures illustrate specific embodiments of the hands-free bag release mechanism, one skilled in the art can appreciate that there are many possibilities that exist for selectively forcing the retractable members to move from a bag-supporting position to a bag-release position, all of which are considered to be within the spirit and scope of the present invention.

It is important to note that the construction and arrangement of the elements of the device provided herein are illustrative only. Although only a few exemplary embodiments of the present invention have been described in detail in this disclosure, those skilled in the art who review this disclosure will readily appreciate that many modifications are possible in these embodiments (such as variations in orientation of the components of the system, sizes, structures, shapes and proportions of the various components, etc.) without materially departing from the novel teachings and advantages of the invention.

Though the disclosed device is primarily described with its application for use with pet waste, note that it is not intended to limit the spirit and scope of the present invention solely for use in conjunction with pet waste. The disclosed device may be utilized to collect and dispose of various types of waste including garbage, debris, or other items requiring collection and disposal.

Once given the above disclosures, many other uses, features, modifications and variations will become apparent to the skilled artisan in view of the teachings set forth herein. Such other uses, features, modifications and variations are, therefore, considered to be a part of this invention, the scope of which is to be determined by the following claims.

The invention claimed is:

1. A waste collection and disposal device, comprising:

a waste receptacle, including:

an elongated handle including a first end and a second end;

a waste receiving member attached to said second end of said elongated handle, said waste receiving member including:

a bottom wall connected to a top wall by a first side wall and by a second side wall, a waste receiving opening and a waste outlet opening, said waste receiving opening and said waste outlet opening being surrounded by said top wall, said first side wall, said second side wall and said bottom wall, wherein said waste receiving opening and said waste outlet opening are connected to form an interior pathway through said waste receiving member, wherein said bottom wall of said waste receiving member is configured to receive waste thereon when waste is received through said waste receiving opening, and wherein said waste is disposed of by urging said waste along said bottom wall from said waste receiving opening through said waste outlet opening; and retractable members connected to said waste receiving member, wherein said retractable members are movable between a bag-supporting position and a bag-release position.

2. The device according to claim 1, further comprising a collection tool, including:

an elongated handle including a first end and a second end;

a rake head attached to said second end of said handle of said collection tool, said rake head including a plurality of tines; and a scraper member attached to a rear face of said rake head.

3. The device according to claim 2, wherein said handle of said waste receptacle further includes a collection tool holder disposed between the first end and the second end of said handle of said waste receptacle, wherein said collection tool holder is configured for attaching said handle of said collection tool to said handle of said waste receptacle.

4. The device according to claim 1, wherein said top wall of the waste receiving member includes apertures for receiving said retractable members, thereby allowing said retractable members to move between said bag-supporting position and said bag-release position.

5. The device according to claim 4, wherein said retractable members protrude through said apertures and above said top wall when said retractable members are in said bag-supporting position.

6. The device according to claim 1, wherein said retractable members are configured and arranged for attachment of bag handles to the retractable members when said retractable members are in said bag-supporting position.

7. The device according to claim 1, wherein said retractable members are retracted beneath said top wall and into the interior of said waste receiving member when said retractable members are in said bag-release position.

8. The device according to claim 1, further comprising a bag including:

an open end for placement around said waste outlet opening;

a closed end for collection of waste; and a first handle and a second handle for attaching said bag to said retractable members when said retractable members are in said bag-supporting position.

9. A method, using the device according to claim 8, for releasably attaching said bag to said waste receiving member, said method comprising the following steps:

placing the opening of said bag around said waste outlet opening of said waste receiving member;

positioning said retractable members in the bag-supporting position;

passing the first bag handle between the handle of the waste receptacle and a first retractable member;

passing the first bag handle in front of the handle of the waste receptacle;

placing an opening in the first bag handle around a second retractable member;

passing the second bag handle between the handle of the waste receptacle and said second retractable member;

passing the second bag handle in front of the handle of the waste receptacle; and placing an opening in said second bag handle around said first retractable member.

10. The method according to claim 9, wherein the bag is detached from said waste receiving member by the following steps:

forcing said retractable members to retract beneath the top wall of said waste receiving member to said bag-release position; and allowing said bag to fall off said waste outlet opening of said waste receiving member.

11. The device according to claim 1, further comprising a spring-loaded push rod member arranged and configured to force said retractable members to move to said bag-release position.

12. The device according to claim 1, further comprising a spring-loaded push rod member, wherein said handle of said waste receptacle is hollow for housing said spring-loaded push rod member.

13. The device according to claim 1, further comprising a spring-loaded push rod member, including a resilient member and a push rod member connected to said resilient member.

14. The device according to claim 13, wherein said resilient member exerts an upward force on said push rod member and yieldably opposes movement of said push rod member in a downward direction.

15. The device according to claim 13, wherein a lower portion of said push rod member is attached to a base, and wherein said retractable members are attached to said base.

16. The device according to claim 15, wherein said push rod member and said base are configured to force said retractable members to move between said bag-supporting position and said bag-release position upon movement of said push rod member.

17. The device according to claim 13, wherein said handle of said waste receptacle further includes a sliding member, and wherein said sliding member is connected to said push rod member for moving said push rod member.

18. The device according to claim 17, wherein said handle of said waste receptacle further includes two slots, wherein a fastener is inserted through said sliding member, through said slots, and through an aperture formed in said push rod member, for connecting said sliding member to said push rod member.

19. The device according to claim 18, wherein said slots are formed longitudinally through said handle of said waste receptacle for allowing said fastener to move through said slots and allowing the sliding member and the push rod member to move with said fastener.

20. The device according to claim 17, wherein said sliding member and said push rod member are arranged and configured to force said retractable members to move into the interior of said waste receiving member into said bag-release position by moving said sliding member in a direction towards said waste receiving member.

21. A method of collecting and disposing of waste, using the device according to claim 17, said method comprising the following steps:

releasably attaching a bag to said retractable members, said retractable members being positioned in said bag-supporting position, said bag including bag handles;

collecting waste with a collection tool, said collection tool including:

an elongated handle including a first end and a second end;

a rake head attached to said second end of said handle of said collection tool, said rake head including a plurality of tines; and a scraper member attached to a rear face of said rake head;

urging said waste into said waste receiving member through said waste receiving opening;

urging said waste into said bag through said waste outlet opening;

positioning said waste receiving member of said waste receptacle over a disposal container so that said waste receiving opening faces upward and said waste outlet opening faces downward toward said disposal container;

moving said sliding member in a direction towards said waste receiving member to force said push rod member to move said retractable members into the interior of said waste receiving member, thereby forcing said bag handles to detach from said retractable members; and allowing said bag to fall off said waste outlet opening and to fall into said disposal container.

22. The device according to claim 1, further including a handle attachment member attached to said top wall of said waste receiving member, said handle attachment member being arranged and configured to receive said second end of said handle, and said handle attachment member including a lip projecting around a top portion of said handle attachment member.

* * * * *